US012440727B2

(12) United States Patent
Kennedy

(10) Patent No.: US 12,440,727 B2
(45) Date of Patent: Oct. 14, 2025

(54) BIFURCATED FACIAL MUSCLE EXERCISING DEVICE AND METHODS OF USING SAME

(71) Applicant: Beauty Balloon LLC, St. Petersburg, FL (US)

(72) Inventor: Catherine Kennedy, St. Petersburg, FL (US)

( * ) Notice: Subject to any disclaimer, the term of this patent is extended or adjusted under 35 U.S.C. 154(b) by 54 days.

(21) Appl. No.: 18/585,582

(22) Filed: Feb. 23, 2024

(65) Prior Publication Data

US 2025/0269229 A1 Aug. 28, 2025

(51) Int. Cl.
*A63B 23/03* (2006.01)
*A45D 44/22* (2006.01)

(52) U.S. Cl.
CPC ..... *A63B 23/032* (2013.01); *A45D 44/22* (2013.01)

(58) Field of Classification Search
CPC ..... A63B 23/032; A45D 44/22
See application file for complete search history.

(56) References Cited

U.S. PATENT DOCUMENTS

D277,031 S * 1/1985 Panicci ..... D24/194
10,569,128 B2 * 2/2020 Hirschinger ..... A63B 23/032
2022/0054886 A1 * 2/2022 Harris ..... A63B 21/028
2022/0233913 A1 * 7/2022 McGhee ..... A63B 23/032
2023/0293938 A1 * 9/2023 Younane ..... A63B 21/0421 482/11

FOREIGN PATENT DOCUMENTS

EP 0556586 A1 * 8/1993 ..... A63B 21/4047

* cited by examiner

*Primary Examiner* — Evan P Dzierzynski
(74) *Attorney, Agent, or Firm* — Harpman + Harpman

(57) ABSTRACT

Exercising methods using an exercising device to strengthen, tighten and tone midface, lower face, orofacial, oropharyngeal including the tongue and floor of mouth muscles for both aesthetic and rehabilitative therapeutic practices is disclosed. A dual facial exercising device having a pair of triangular tubular shaped body members of a primary triangular configuration joined together at their respective apexes. The combined triangular shaped body defines central openings with equal, compressible, and bendable body members there about for designated placement to perform isometric and isotonic muscle resistance training for a variety of facial and tongue exercises. An exercise methodology with universal placement under the lower lip, upper lip, both lips, unilateral or bilateral cheeks, in and around the outer region of the mouth, inside the oral cavity for hard palate, surface of the tongue and floor of mouth engagement.

7 Claims, 9 Drawing Sheets

BIFURCATED FACIAL MUSCLE EXERCISING DEVICE AND METHODS OF USING SAME

BACKGROUND OF THE INVENTION

1. Technical Field

The present invention relates to the field of exercising facial muscles, and more specifically to a facial exercise device used to strengthen, tighten, and tone midface, lower face, orofacial, oropharyngeal and floor of mouth muscles of a user.

BACKGROUND

Throughout history, various cultures have explored techniques to enhance facial aesthetics through non-invasive methods such as facial exercise and massage. These practices aim to rejuvenate the aging face by restoring a more youthful appearance. The modern-day advances in medicine, technology and science have paved the way for solutions to the aging face that harness not only the aesthetic benefits but also the functional and health benefits of facial exercise. In particular, many functional and health benefits are seen with exercise to strengthen the orofacial and oropharyngeal muscles which are widely established in many rehabilitative therapeutic practices. Aesthetic benefits of facial exercise work to restore the underlying structure of the face to improve facial contours, shape, and lost volume resulting in a more youthful appearance. The functional and health benefits of facial muscle exercise are most notably observed within rehabilitative therapeutic practices for such conditions as stroke, Bell's palsy, and dysphagia. Specific exercises are performed in order to rehabilitate facial and oral muscle function, as well as to restore facial symmetry and balance for aesthetic benefits. Myofunctional therapeutic practices for the treatment of Orofacial Myofunctional Disorders (OMDs) and Sleep-Related Breathing Disorders (SRBDs) has shown to improve the dynamic muscle discord (DMD) that is associated with these disorders due to chronic mouth-breathing. Habitual mouth-breathing can cause the orofacial and oropharyngeal muscles to weaken, and atrophy which can lead to episodic partial or complete collapse of the upper airway during sleep resulting in apneic events. By restoring the harmonic balance of the orofacial and oropharyngeal muscles, SRBDs including the current epidemic in the US, Obstructive Sleep Apnea (OSA), and the common condition of snoring can be improved with muscle exercise to strengthen, tighten, and tone the orofacial, and oropharyngeal muscles including the tongue and floor of mouth muscles to restore proper nasal breathing. OSA represents an example of a SRBD in which orofacial and oropharyngeal DMD can lead to serious health consequences such as hypertension, diabetes, or sudden death. In addition, undesirable facial anatomic changes due to chronic mouth-breathing occur in SRBDs and OMDs due to different muscle engagement when mouth-breathing versus nasal breathing. Accordingly, a novel facial muscle exercise device and method for a variety of both isometric and isotonic resistance training exercise therein set forth to strengthen, tighten and tone orofacial, oropharyngeal and floor of mouth muscles may help improve the current epidemic of OSA and improve the undesirable facial anatomic changes associated with SRBDs and OMDs due to chronic mouth-breathing, thereby, imparting improved facial aesthetic outcomes of a user.

The current facial muscles exercise devices that fit into the mouth have moving parts which can be confusing and for the most part are complicated to use and therefore present several challenges and disadvantages to users. Some devices may require users to perform intense or repetitive facial movements which could potentially lead to over exertion or strain on the delicate facial muscles. Over exertion may result in discomfort, pain, or even worsen certain underlying medical conditions such as Temporomandibular Dysfunction (TMD). Other devices are limited in their overall scope of use, failing to target critical muscles needed for facial aesthetic rejuvenation or rehabilitative therapeutic practices in SRBD's and OMD's including OSA and snoring.

2. Description of Prior Art

Prior art patents related to facial exercise devices developed for strengthening facial muscles by providing different resistant inducing structures, see for example U.S. Pat. Nos. 5,556,357, 5,919,116, 6,409,404, 7,462,132, 7,476,180, 7,887,461, U.S. Publication 2014/0141938 and D929,512.

In U.S. Pat. No. 5,556,357 discloses a face, neck and chin exercise having a guard strip and a grip piece for holding strip in position during mouth movements and forming an O and a smile.

U.S. Pat. No. 5,919,116 claims an exercise device for facial muscle and mouth with oppositely disposed mouth engagement components interconnected by a resilient component for repetitive lateral compression.

U.S. Pat. No. 6,406,404 illustrates a facial muscle exercising device having a pair of lip engaging members in longitudinal orientation to urge apart by compressible central spring.

U.S. Pat. No. 7,462,132 claims an exercise device for facial muscles comprising a bifurcated armature with registering engagement pads adapted to receive teeth with an interlinking adjustment.

U.S. Pat. No. 7,476,180 discloses an exercise device for the jaw and facial muscles with a pair of hinged mouth engagement plates with corresponding formed channels for upper and lower teeth.

U.S. Pat. No. 7,887,461 is directed to a lip strengthening device having a hinged articulating axis with a biasing spring there between. Lip engagement arms each position the device either vertically or horizontally between the user's lips.

U.S. Patent Publication 2016/0141939 discloses a face and lip exerciser and methods of use having an elongated body member with lip mouth insert lip engagement and a light insertion point handle extending therefrom.

U.S. Design Pat. No. D929,510 shows an annular design for a lip engagement device with a pair of lip extension arms interconnected by resilient interim element.

Applicant's pending application Ser. No. 18/505,410, filed Nov. 9, 2023 on a Facial Muscle Exercising Device and Method of Using Same discloses a single triangle device and exercises used there with.

SUMMARY OF THE INVENTION

A facial muscle exercising device and a variety of methods for both isometric and isotonic resistance training to strengthen, tighten and tone midface, lower face, orofacial, oropharyngeal and floor of mouth muscles for both aesthetic benefits and rehabilitation therapeutic practices of a user thereof is disclosed.

The primary embodiment of the facial muscle exercising device comprises a bifurcated dual triangle shaped body for placement into different anatomic spaces in and around the mouth, oral cavity, lips, and cheeks for unilateral or bilateral use. The device can be placed in the cheeks, unilaterally or bilaterally, under the upper lip, lower lip or both lips. The device can be placed across the lower teeth, back teeth, between the front and back teeth, placed inside the oral cavity to contact the hard palate, surface of the tongue or floor of mouth below the lower teeth of the user. The dual triangle shaped body members have a pair of flexible and compressible tubular configuration each with three interlinked portions. The three portions define independent triangles and each portion of the respective tubular body members presents a side of the respective triangle. The three portions define a pairs of center openings through which the tongue can protrude to perform a variety of resistance training exercises to strengthen the oropharyngeal muscles including the tongue and floor of mouth muscles. The triangle body members are joined together at each respective apexes allowing for bilateral flexing along a translateral arc. The invention is used for both isometric and isotonic resistance training for the midface, lower face, orofacial, oropharyngeal, including the tongue and floor of mouth muscles.

DETAILED DESCRIPTION OF THE INVENTION

Figure 1:
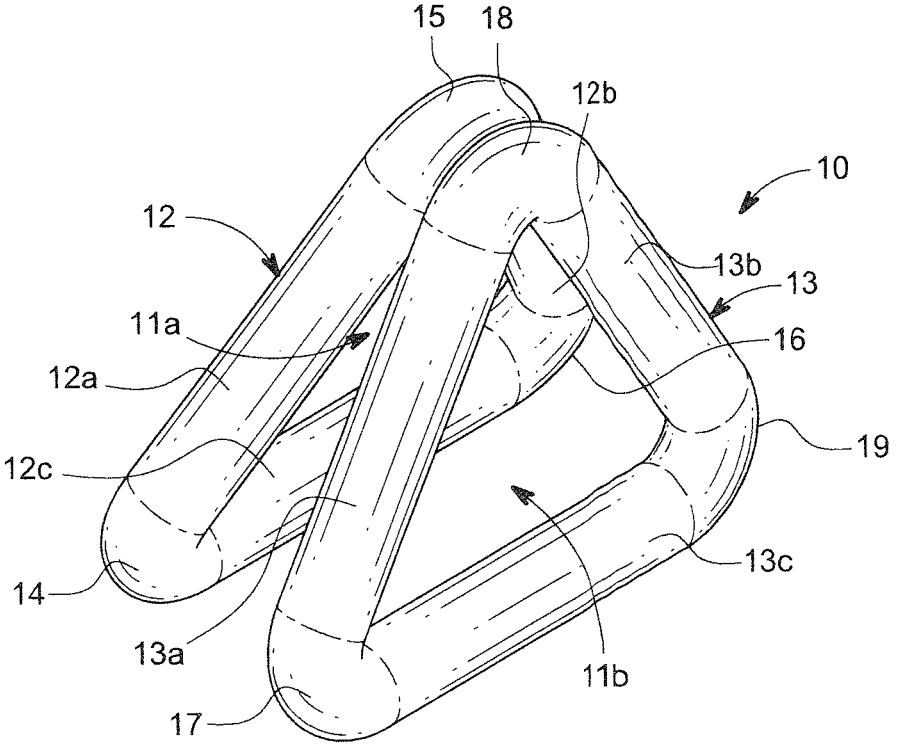
FIG. 1 is a perspective view of the dual triangle facial muscle exercising device of the invention.
Figure 2:
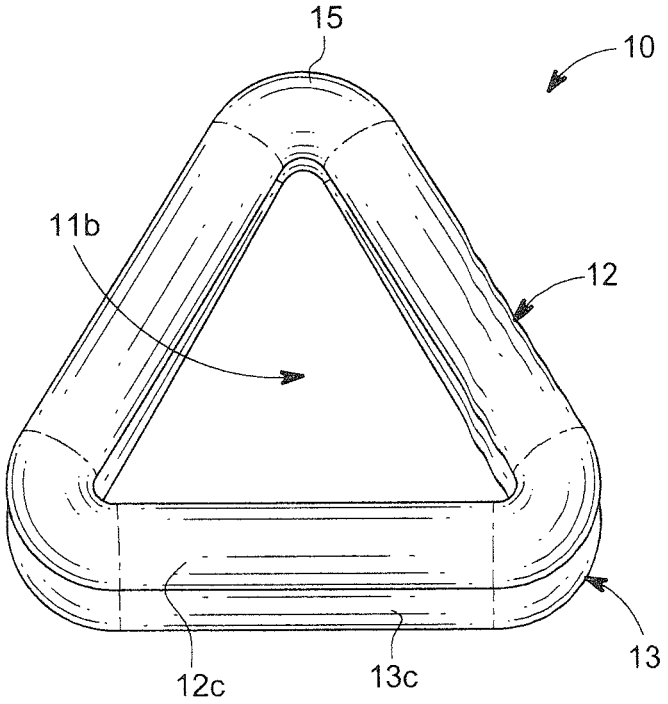
FIG. 2 is a rear elevational view thereof.
Figure 3:
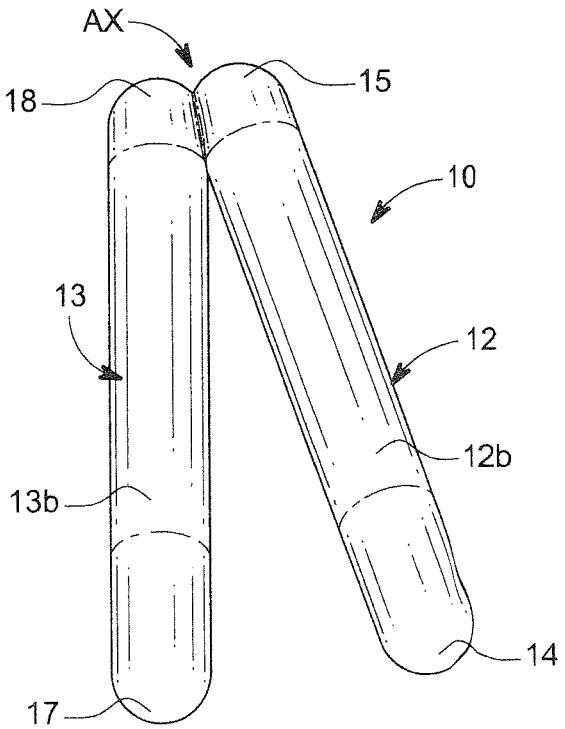
FIG. 3 is a right-side elevational view thereof.
Figure 4:
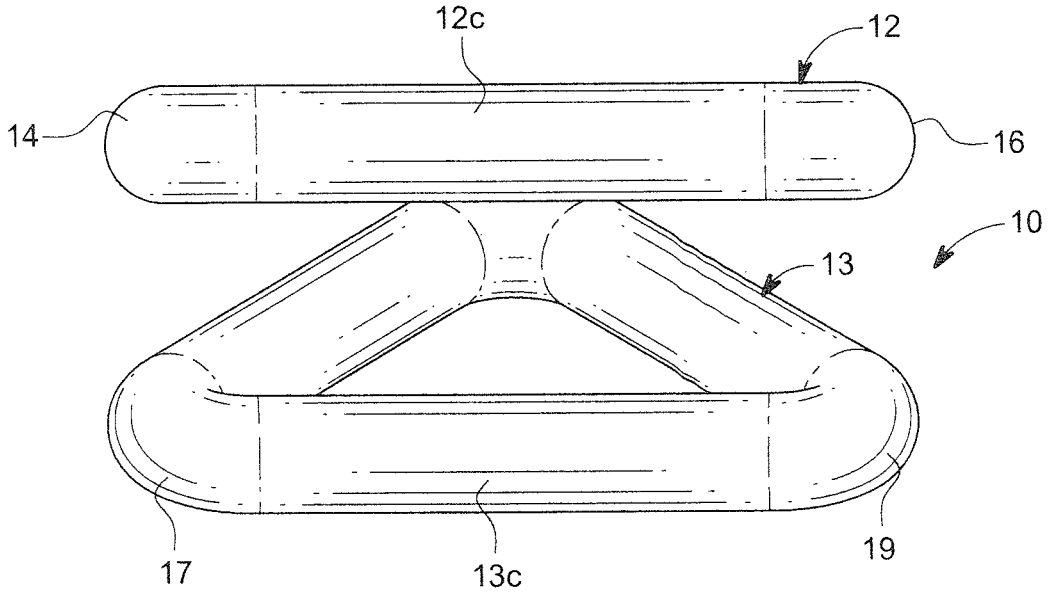
FIG. 4 is a bottom plan view thereof.

The following detailed description refers to the accompanying drawings whenever possible, the same reference numbers are used in the drawings and following the descriptions and refer to the same or similar elements. While disclosed embodiments may be described, modifications, adaptations and implementations are also possible. Accordingly, the following detailed description does not limit the disclosed embodiment. Instead, the proper scope of the disclosure and embodiment is defined by the appended.

The disclosed invention improves upon the prior art defining, a stand-alone dual facial muscle exercising device 10 of the invention by providing a device that occupies less space and volume inside the mouth for much user versatility. The dual facial muscle exercising device 10 has a pair of bodies made of a flexible and compressible tubular structure that defines a center opening in the bodies occupying less space and volume, thereby augmenting the effectiveness of the device 10 within and around the mouth so to reposition the device into multiple anatomic spaces for a variety of exercises. The dual facial muscle exercise device 10 provides a pair of central triangular openings at 11A and 11B that allows a user to engage the device with the tongue and easily reorient the device inside or around the mouth for a variety of orofacial, oropharyngeal and floor of mouth exercises. The dual facial muscle exercising device 10 improves over prior art providing soft flexible resilient bodies joined together that facilitates facial exercises for both aesthetic and rehabilitative therapeutic practices as aforementioned.

Referring specifically now to FIGS. 1-16 of the drawings, the dual facial muscle exercise device 10 can be seen for strengthening midface, lower face, orofacial, oropharyngeal including tongue and floor of mouth muscles of the user U for both aesthetic and rehabilitative therapeutic practices. As noted, the dual facial exercise device 10 comprises a pair of flexible and compressible triangle shaped tubular body members 12 and 13 joined together, in this example, respective intersecting tubular elements 12A, 12B, 12C and 13A, 13B and 13C defining dual triangles wherein the elements 12A, 12B and 13A and 13B define sides of the respective triangles and at an apexes A and the elements 12C and 13C defines the respective base as in integral and stable one-piece constructions.

As discloses herein, each of the triangle shaped bodies 12 and 13 are made of a single flexible and compressible tubular element, however, it is understood that the triangle bodies may also be made by joining two or more flexible tubular elements together. It is understood that for term of disclosure that the facial muscle exercise device has been used interchangeably throughout the application.

The triangle shaped body members 12 and 13 each have three vertices 14, 15, 16 and 17, 18 and 19 and each of the elements form an angle with an adjacent portion at a vertex between the two elements. The respective triangle shape body members 12 and 13 are joined together at their corresponding vertices 15 and 18 apexes thereby defining an inverted V-shaped construction, best seen in FIGS. 1-4 of the drawings. The inherent flexibility of the dual joined triangle design allows for enhanced, and varied exercises and unique divisional positioning within and around the mouth M, lips and cheeks C to perform different facial exercises as will be described in detail hereinafter.

The center openings 11A and 11B in the respective triangle shaped bodies 12 and 13 and allows the user to engage facial muscle exercise device 10 with the tongue T illustrated in FIGS. 5-7 and 10-13 with the placement of the device inside or around the mouth M to assist in a variety of isometric and isotonic resistance training exercises for the orofacial, and oropharyngeal muscles including the tongue and floor of mouth muscles with much ease by a user. Flexible tubular body members 12 and 13 are made, in this example, of resilient medical grade material such as thermoplastic polyethylene (TPU), thermoplastic elastomer (TPE) or silicone.

The resilient nature of the tubular material provides compliant structures that retain shape during user engagement for both isometric and isotonic resistance training as will be described in greater detail hereinafter. It is understood that both isometric and isotonic exercises are performed in repetition in each example.

In operation, method steps using defined placement and users' completion of interactive exercise repetitions enabled thereby. Representative examples of exercise device placement to perform isometric and isotonic resistance training exercises are as follows.

Figure 5:
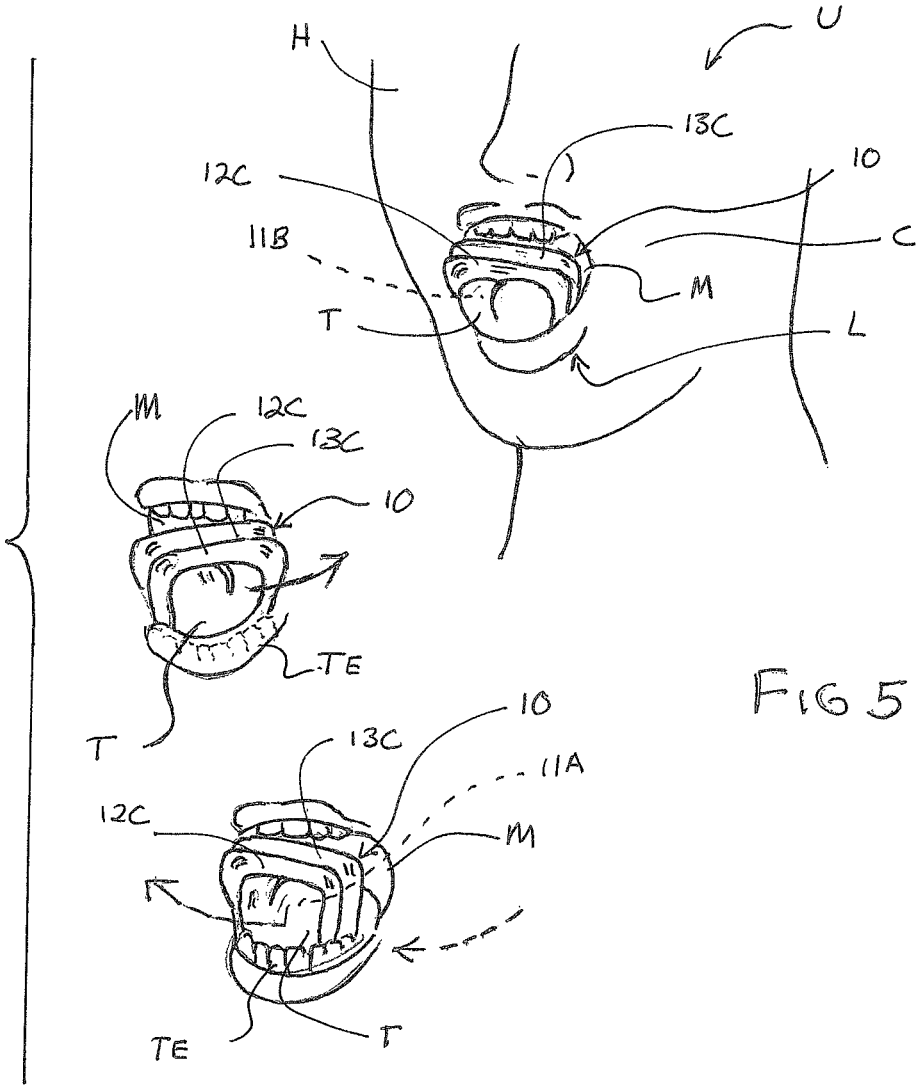
FIG. 5 are a partial multiple composite graphic facial illustrations of a user's mouth with the triangular dual apex behind lower teeth on floor of mouth for side-to-side tongue movement.

Referring now to FIG. 5 of the drawings, the placement of the facial muscle exercise device 10 apexes are selectively positioned behind the lower teeth TE resting on the floor of the mouth in the figures. The user's tongue T engages the dual openings 11A and 11B and moves side to side indicated by directional arrows against the resistance of the device as a "reverse plank with a twist". Bases 12C and 13C should not touch upper lip or upper teeth for optimum tongue and floor of mouth resistance training. Extension of user's U head H back can assist with exercise form.

Figure 6:
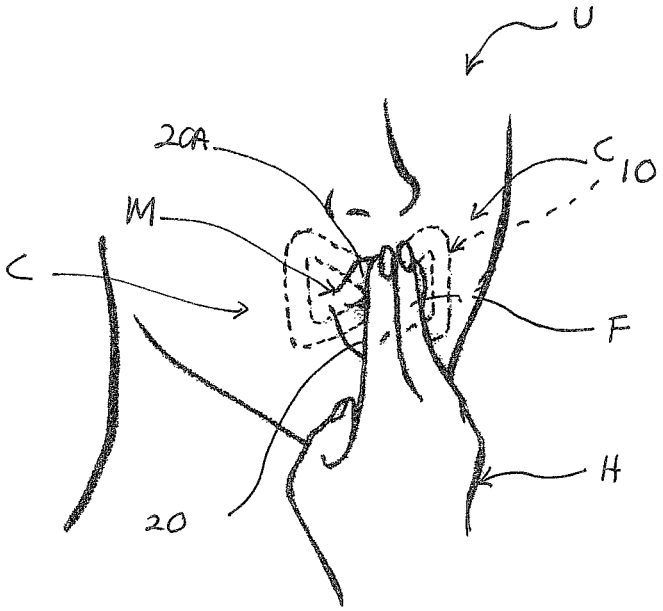
FIG. 6 is a partial perspective facial illustration of the dual triangle exercise device across teeth and held by the user.

Referring now to FIG. 6 of the drawings, exercise device 10 is positioned in the mouth M to straddle across the teeth, not shown, on both sides of the gum area. The cheeks C are sucked inwardly by the user U creating a concave appearance and held for resistant training of the lower cheeks. Fingers F can be placed over pursed lips 20 and 20A to create a seal defining a so-called "cheek straddle suck" exercise.

Figure 7:
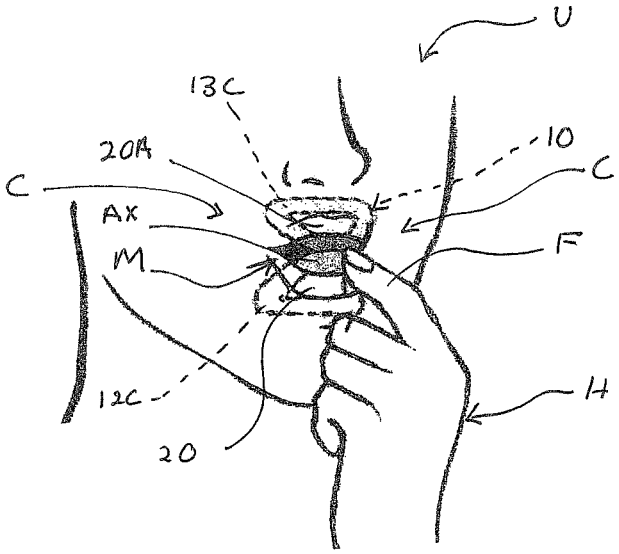
FIG. 7 is a partial perspective facial illustration of the dual triangle exercise device in the user's mouth under user's lips being held in place by user's finger.

In FIG. 7 of the drawings, a "lip swell" exercise is illustrated wherein the dual exercise device 10 respective bases 12C and 13C are positioned under the corresponding upper and lower lips 20 and 20A and held in place by an index finger F on their joined apexes. The user U then contracts their lips over the device for resistant training thereto. The user may say the letter "O" when conducting the exercise to increase or enhance its viability.

Figure 8:
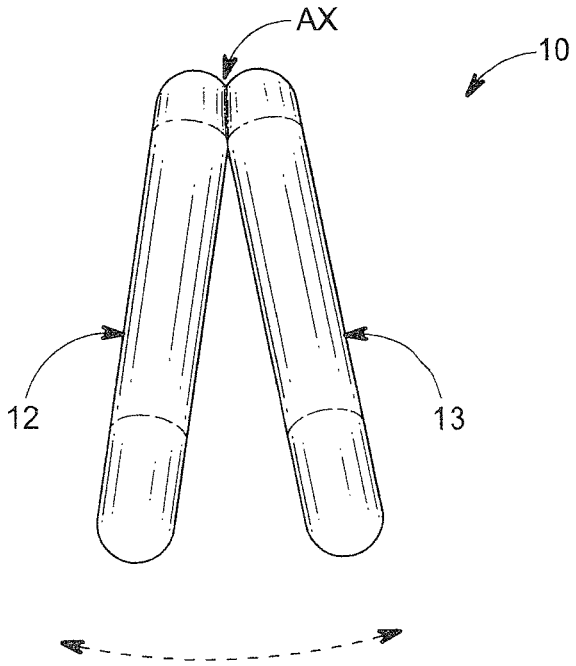
FIG. 8 is an enlarged graphic illustration of the dual exercise device showing bilateral flexion thereof.
Figure 9:
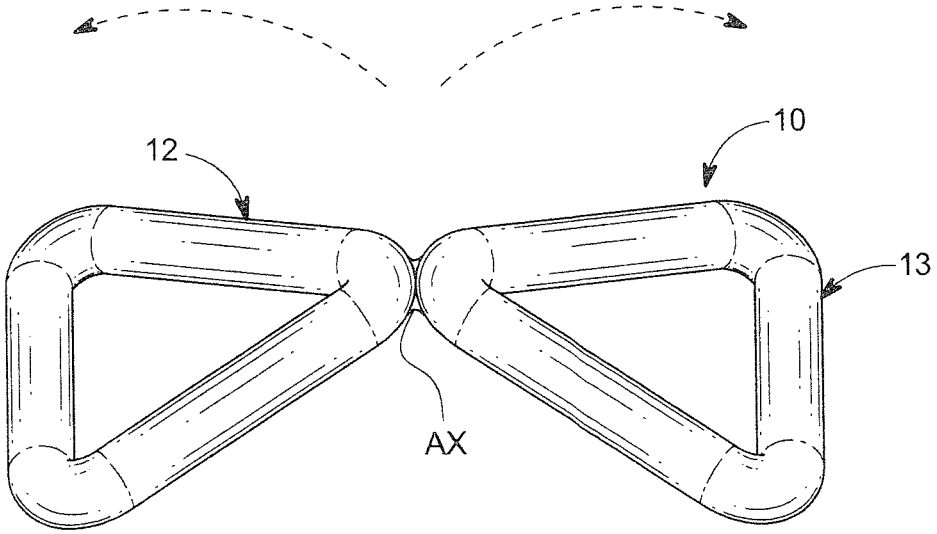
FIG. 9 is an enlarged graphic illustration of the dual exercise device in divergent end to end longitudinal extension under applied opposing force.

Referring now to FIGS. 8 and 9 of the drawings, the flexibility of the dual facial exercise device 10 imparted by the conjoined body members 12 and 13 at their apex AX can be seen. This unique construction affords flexibility, not only of the dual body members to one another but by positional variations as to the unique facial exercises as seen in the respective illustrations which are unattainable by a single triangle configuration as described in applicant's co-pending application documented in the description of prior art.

The unique flexibility achieved by the dual exercise device 10 is evident in the exercises illustrated in FIGS. 6, 7, and 10-13 of the drawings.

Figure 10:
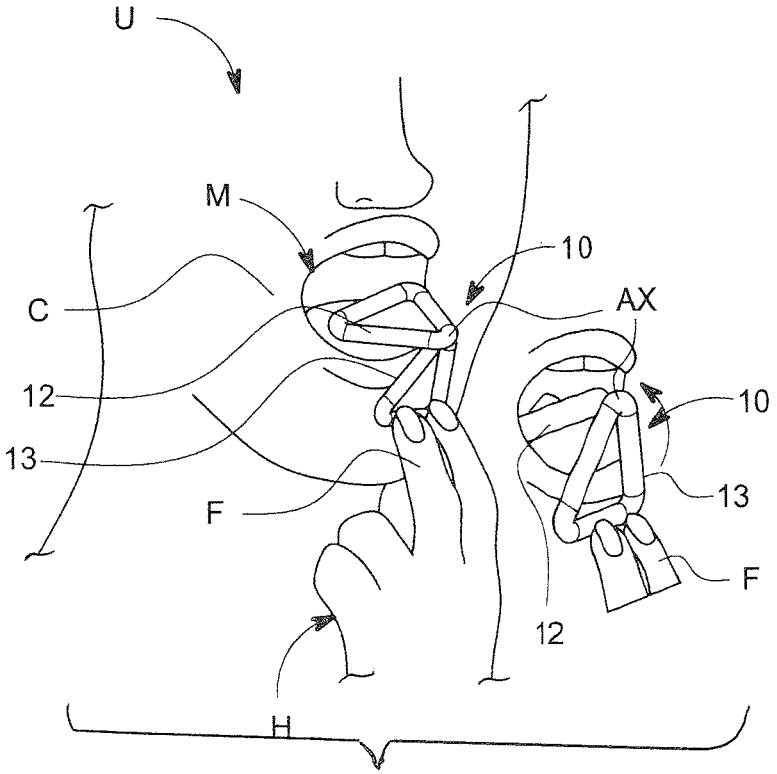
FIG. 10 is a partial composite perspective facial illustration of the dual exercise device with one of the triangles of the device in the mouth engaged by the user's tongue and hand outside thereof.

In composite FIG. 10 of the drawings shows the placement of one triangle 12 in the mouth M with user's hand H and fingers F holding the hinged outwardly extending triangle 13 to impart an oropharyngeal including the tongue strengthening exercise as illustrated in the composite illustrations.

Figure 11:
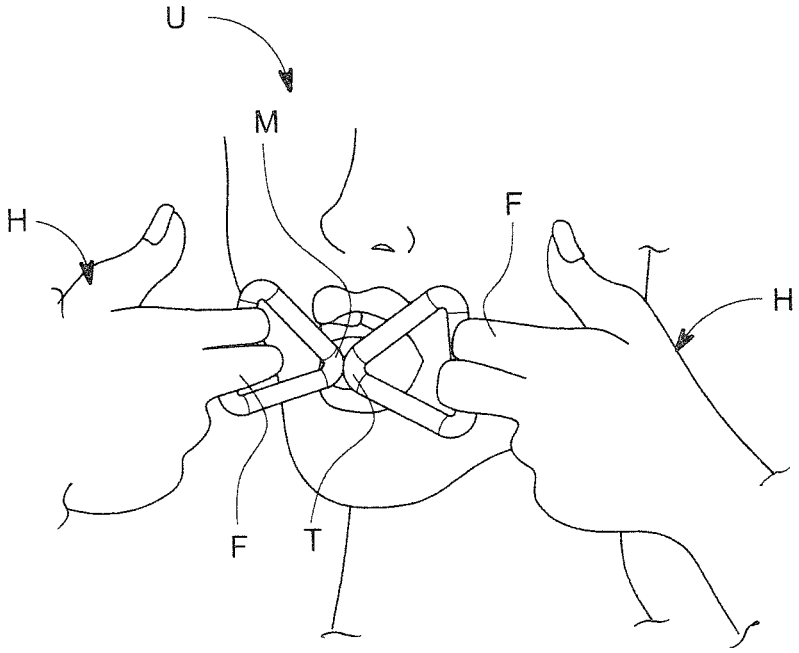
FIG. 11 is a partial perspective facial illustration where the user's tongue is pushed against the exercise device apex attachment point as the device is held open longitudinally by user's hands.
Figure 12:
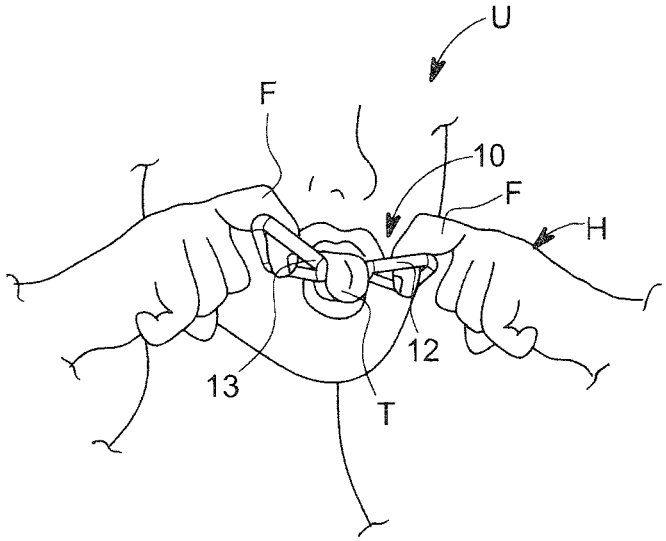
FIG. 12 is a partial perspective facial illustration of the dual triangle facial exercise device held in extended longitudinal position with user's tongue extending there over against the resistance thereof.
Figure 13:
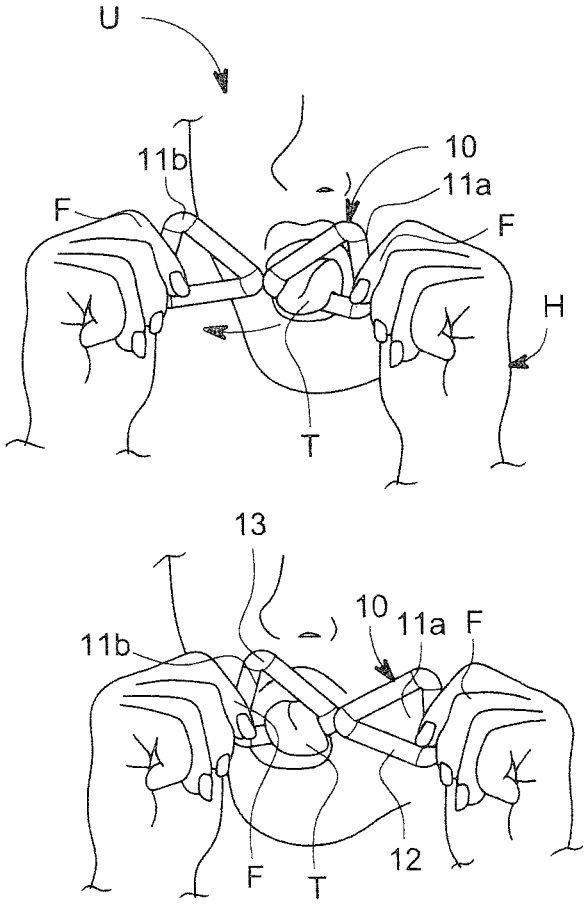
FIG. 13 is a partial composite perspective facial illustrations of the dual triangle facial exercise device held in extended open position with the tongue protruding alternately through respective openings against the opposing resistance thereof.

Referring now to FIGS. 11-13 of the drawings which are directed to the tongue muscles utilizing the longitudinally stretched separation of the two triangles 12 and 13 engaged by their user's respective hands H and fingers F on their corresponding bases 12C and 13C.

FIG. 11 refers to a "tongue slingshot" exercise wherein pushing the tongue T against the connection center apexes AX between the respective triangles towards the mouth for resistant training. This is both isometric and isotonic movement can be performed. In FIG. 12 of the drawings, a "tongue trampoline" exercise is illustrated holding the device 10 open longitudinally as noted and sticking the tongue T outwardly and pressing down with the tongue T over the device 10 and pulling up simultaneously as to bounce the tongue T in resistance thereto.

Referring now to multiple composite FIG. 13 of the drawings, a further longitudinal stretching of the device 10 held by the user's fingers F can be seen with the user's tongue T extending through the respective alternate triangle openings 11A and 11B moving the tongue Tin opposite directional orientation to the opposing lateral input there against the resistance for tongue muscle resistance training referred to as the "tongue two step" exercise.

Figure 14:
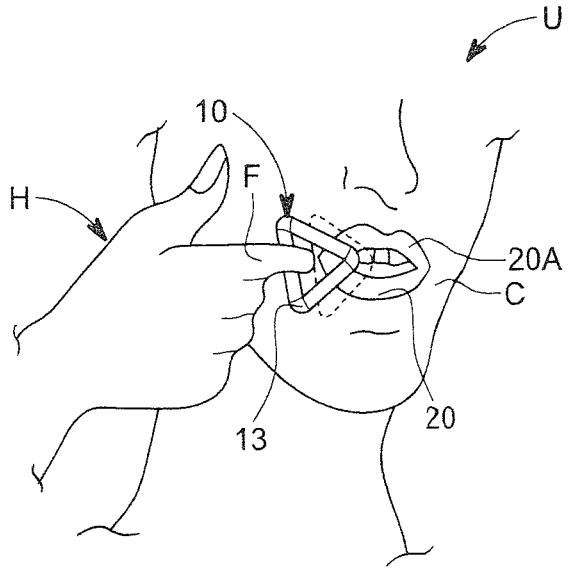
FIG. 14 is a partial perspective facial illustration of the dual exercise device partially inserted into the mouth of the user under one cheek and pulled by the user's hands there against.
Figure 15:
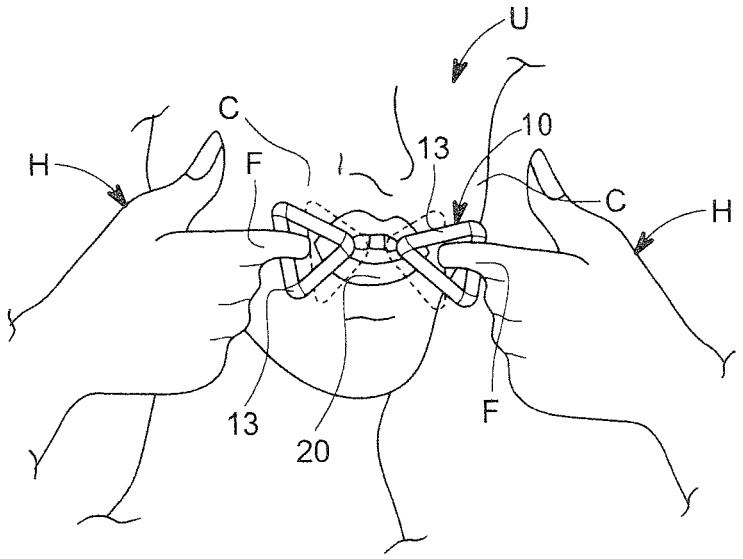
FIG. 15 is a partial perspective facial illustration of the dual exercise device positioned alternately bilaterally under the user's cheeks and engaged by the exterior portion for longitudinal force displacement.
Figure 16:
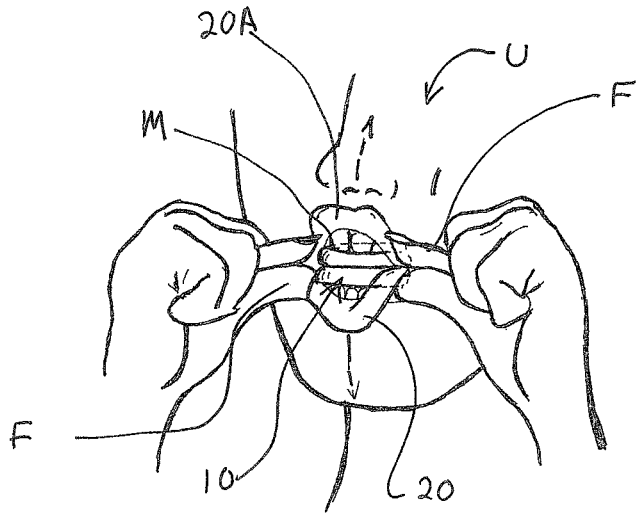
FIG. 16 is a partial perspective facial illustration of the dual triangle exercise device in the user's mouth with the user's lips being held on both sides for guidance of outward radial lip extension exercise training.

"Cheek tug" exercises can be seen in FIGS. 14 and 15 of the drawings wherein the device 10 is partially inserted into the respective cheek with the hinge exposed portion 13, in this illustration, engaged by the user's respective index finger F to impart resistance thereto singly or in opposing bilateral orientation illustrated in FIG. 15 of the drawings where a pair of facial exercise devices 10 are used and positioned in opposite bilateral cheeks C with body member portions 13 extending, as noted above, and engagement by the user for bi-directional force input.

It will be evident that the dual facial muscle dual facial exercise device 10 can be used universally for a variety of both isometric and isotonic resistance training exercise for the midface, lower face, orofacial, oropharyngeal including the tongue and floor of mouth muscles to which can only be accomplished by its unique versatility of use.

A variety of facial muscle strengthening, tightening and toning exercises are achieved for aesthetic and rehabilitative therapeutic practices. Muscles of the oropharynx including the tongue are strengthened to improve the DMD that is associated with SRBDs and OMDs including the epidemic OSA and the common condition of snoring as a result of nighttime chronic mouth-breathing.

The mechanism of action of dual facial exercise device 10 is twofold, first, increases the range of motion enabling muscle fibers to work most effectively thereby increasing muscle blood flow. Second, provides the resistance for isometric and isotonic resistance training exercise. Correspondingly, many aesthetic and health benefits are gained with use of dual facial exercise device 10. For example, by reaching the deep muscle fibers of the lip muscle, the sphincter component of the lip muscle, poor lip seal strength commonly associated with mouth-breathing, dysphagia and stroke can be improved. Poor lip seal strength resulting from chronic mouth-breathing contributes to SRBDs and OMDs including OSA and snoring as well as dysphagia and stroke associated drooling. Improving lip seal strength with the use of dual exercise device 10 can help to improve SRBDs, and OMDs including OSA, and snoring as well as rehabilitate dysphagia and stroke associated drooling. Accordingly, the aesthetic benefits of a strong lip seal include improvement in lip volume and structure. There is improvement in lip contours, shape, and symmetry as a result of muscle hypertrophy from resistance training. The corners of the mouth are lifted, undesirable vertical lip lines are improved and a desired shortening of the upper lip philtrum may be achieved as a result of hypertrophy of the lip muscle with use of device 10. Subsequently, use of device 10 for cheek enhancement results in lifted, sculpted and revolumized cheeks as the mid, lateral and lower cheek muscles are strengthened, tightened and toned. The variety of tongue, floor of mouth and neck muscle exercises accomplished with the use of the dual exercise device 10 results in a more defined jawline, improvement in the cervicomental angle, less visible tech neck lines and improvement in the undesirable double chin as the orofacial, oropharyngeal, floor of mouth and neck muscles are tightened and toned through isometric and isotonic resistance training.

As hereinbefore described, the dual facial exercise device 10 so defined by multiple triangular connecting elements 12 and 13 impart enhanced stability, resistant support elements assuring proper resistant performance in use applications as hereinbefore disclosed.

It will be evident from the above descriptions and examples that a variety of non-illustrated exercises can also be achieved by strategic placement of the dual facial muscle exercise device 10 that will benefit users for both aesthetic and health related purposes as seen in rehabilitative therapeutic practices as described herein above.

Thus, it will be seen that a new and novel dual facial muscle exercise device 10 has been illustrated which provides aesthetic and health related benefits users and it will be apparent to those skilled in the art that various changes and modifications may be made therein without departing from the spirit of the invention.

Therefore, I claim:

1. A method of select isometric and isotonic resistance exercises for aesthetic and rehabilitative therapeutic practices for midface, lower face, orofacial, oropharyngeal including the tongue and floor of mouth muscles comprises the steps of, a. providing a pair of triangularly shaped resilient tubular joined body members, b. positioning said triangularly shaped resilient tubular joined body members into select positions of a user's mouth and cheeks, c. holding said triangularly shaped resilient tubular joined body members in alternate under and over the lip of said user's mouth, d. repeatedly engaging said triangularly shaped resilient tubular joined body members with isometric and isotonic resistance training exercises of said user's midface, lower face, orofacial, oropharyngeal including said tongue and floor of mouth muscles in prescribed sequences and duration to strengthen, tighten and tone the desired muscles, e. alternating the position of the triangularly shaped resilient tubular joined body members for unilateral and bilateral specific muscle engagement by repetitive sequence facial movements including user's manual engagement thereof, f. positioning the triangularly shaped resilient tubular joined body members for engagement of user's tongue through openings defined by said triangularly shaped body tubular resilient joined body members in multiple tongue extended positional orientations and durations, g. positioning the triangularly shaped resilient tubular joined body members for engagement of users' tongue in multiple planes they're against.

2. The method of claim 1 wherein the step of providing a pair of triangularly shaped resilient tubular joined body members comprises, first and second yielding tubular body members each having multiple interlinking portions with a base, adjoining upstanding angularly disposed side portions defining an apex of said triangle body member, said tubular joined body members joined at their respective apexes.

3. The method of claim 1 wherein said step of repeatedly engaging said triangularly shaped resilient tubular joined body member by isometric and isotonic facial movements comprises, contracting muscles for compressing engagement against surfaces of the triangularly shaped resilient tubular joined body members independently and singularly between the respective lips, gums, and inner cheeks selectively of the user unilaterally and bilaterally.

4. The method of claim 1 wherein the step of positioning the triangularly shaped resilient tubular joined body members for engagement of user's tongue through defined openings, comprises, positioning the triangular shaped resilient tubular joined body for extending user's tongue alternately through said defined openings, moving the tongue in opposite directional orientation to the opposing lateral input there against.

5. The method of claim 1 wherein said step of positioning the resilient triangularly shaped resilient tubular joined body members for engagement of user's tongue comprises, holding the resilient tubular joined body members open for extending user's tongue over the respective joined apexes of the resilient tubular jointed body members and pressing down with the tongue against upward pull of device 10 thereof.

6. The method of claim 1 wherein the step of positioning the resilient triangularly shaped resilient tubular joined body members stretched open for the joined apexes to resist against the user's tongue comprises, independently holding said first and second tubular joined body members in longitudinally extending position for user's tongue resistant engagement against the joined connected apexes of said joined resilient tubular body members.

7. The method of claim 1 wherein said the step of repeatedly engaging said triangularly shaped resilient tubular joined body members by isometric and isotonic facial movements of user's mouth further comprises, positioning first of said resilient tubular body member in user's respective inner cheeks, straddling respective inner cheek, for outward lateral cheek resistance training by repetitively pulling on said second tubular body member and said cheek for unilaterally and bilaterally cheek resistance training.

* * * * *